US005507052A

United States Patent [19]

Smith et al.

[11] Patent Number: 5,507,052

[45] Date of Patent: Apr. 16, 1996

[54] RIM CLEANING BEVERAGE CONTAINER OPENER

[76] Inventors: Nickie Smith; Daniel Persico, both of 38 Roosevelt St., Yonkers, N.Y. 10701

[21] Appl. No.: 386,115

[22] Filed: Feb. 9, 1995

[51] Int. Cl.[6] ..... B67B 7/44

[52] U.S. Cl. ..... 7/151; 7/105; 15/105; 15/245

[58] Field of Search ..... 7/105, 151, 169, 7/170; 15/117, 245; 81/3.55

[56] References Cited

U.S. PATENT DOCUMENTS 4,757,568 7/1988 Jones ..... 7/151 X 4,835,812 6/1989 Su ..... 7/151 X 5,077,850 1/1992 Brubaker ..... 7/151

*Primary Examiner*—James G. Smith

[57] ABSTRACT

A cleaning opener for cleaning a rim of a beverage container and facilitating manual opening thereof. The inventive device includes a handle having a squeegee assembly at a first end thereof for engaging and cleaning a rim of the container to remove debris therefrom. An opening assembly extends from a second end of the handle for facilitating manual opening of a beverage can or bottle.

9 Claims, 2 Drawing Sheets

RIM CLEANING BEVERAGE CONTAINER OPENER

BACKGROUND OF THE INVENTION

1. Field of the Invention

The present invention relates to opening implements and more particularly pertains to an rim cleaning beverage container opener for a rim cleaning beverage container opener for cleaning a rim of a beverage and facilitating manual opening thereof.

2. Description of the Prior Art

The use of opening implements is known in the prior art. More specifically, opening implements heretofore devised and utilized are known to consist basically of familiar, expected and obvious structural configurations, notwithstanding the myriad of designs encompassed by the crowded prior art which have been developed for the fulfillment of countless objectives and requirements.

Known prior art opening implements include U.S. Pat. No. 4,951,344; U.S. Pat. No. 4,961,510; U.S. Pat. No. 5,244,111; U.S. Pat. No. 4,802,927; and U.S. Pat. No. 5,031,264.

While these devices fulfill their respective, particular objectives and requirements, the aforementioned patents do not disclose a rim cleaning beverage container opener for a rim cleaning beverage container opener and facilitating manual opening of the container which includes a handle having a squeegee assembly at a first end thereof for cleaning a rim of the container, with an opening assembly extending from a second end of the handle for facilitating manual opening of a beverage can or bottle.

In these respects, the rim cleaning beverage container opener according to the present invention substantially departs from the conventional concepts and designs of the prior art, and in so doing provides an apparatus primarily developed for the purpose of cleaning a rim of a beverage container and facilitating manual opening thereof.

SUMMARY OF THE INVENTION

In view of the foregoing disadvantages inherent in the known types of opening implements now present in the prior art, the present invention provides a new rim cleaning beverage container opener construction wherein the same can be utilized for cleaning a rim of a beverage container and facilitating manual opening thereof. As such, the general purpose of the present invention, which will be described subsequently in greater detail, is to provide a new rim cleaning beverage container opener apparatus and method which has many of the advantages of the opening implements mentioned heretofore and many novel features that result in a rim cleaning beverage container opener which is not anticipated, rendered obvious, suggested, or even implied by any of the prior art opening implements, either alone or in any combination thereof.

To attain this, the present invention generally comprises a cleaning opener for cleaning a rim of a beverage container and facilitating manual opening thereof. The inventive device includes a handle having a squeegee assembly at a first end thereof for engaging and cleaning a rim of the container to remove debris therefrom. An opening assembly extends from a second end of the handle for facilitating manual opening of a beverage can or bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rim cleaning beverage container opener apparatus and method which has many of the advantages of the opening implements mentioned heretofore and many novel features that result in a rim cleaning beverage container opener which is not anticipated, rendered obvious, suggested, or even implied by any of the prior art opening implements, either alone or in any combination thereof.

It is another object of the present invention to provide a new rim cleaning beverage container opener which may be easily and efficiently manufactured and marketed.

It is a further object of the present invention to provide a new rim cleaning beverage container opener which is of a durable and reliable construction.

An even further object of the present invention is to provide a new rim cleaning beverage container opener which is susceptible of a low cost of manufacture with regard to both materials and labor, and which accordingly is then susceptible of low prices of sale to the consuming public, thereby making such rim cleaning beverage container openers economically available to the buying public.

Still yet another object of the present invention is to provide a new rim cleaning beverage container opener which provides in the apparatuses and methods of the prior art some of the advantages thereof, while simultaneously overcoming some of the disadvantages normally associated therewith.

Still another object of the present invention is to provide a new rim cleaning beverage container opener for cleaning a rim of a beverage container and facilitating manual opening thereof.

Yet another object of the present invention is to provide a new rim cleaning beverage container opener which includes a handle having a squeegee assembly at a first end thereof for cleaning a rim of the container, with an opening assembly extending from a second end of the handle for facilitating manual opening of a beverage can or bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
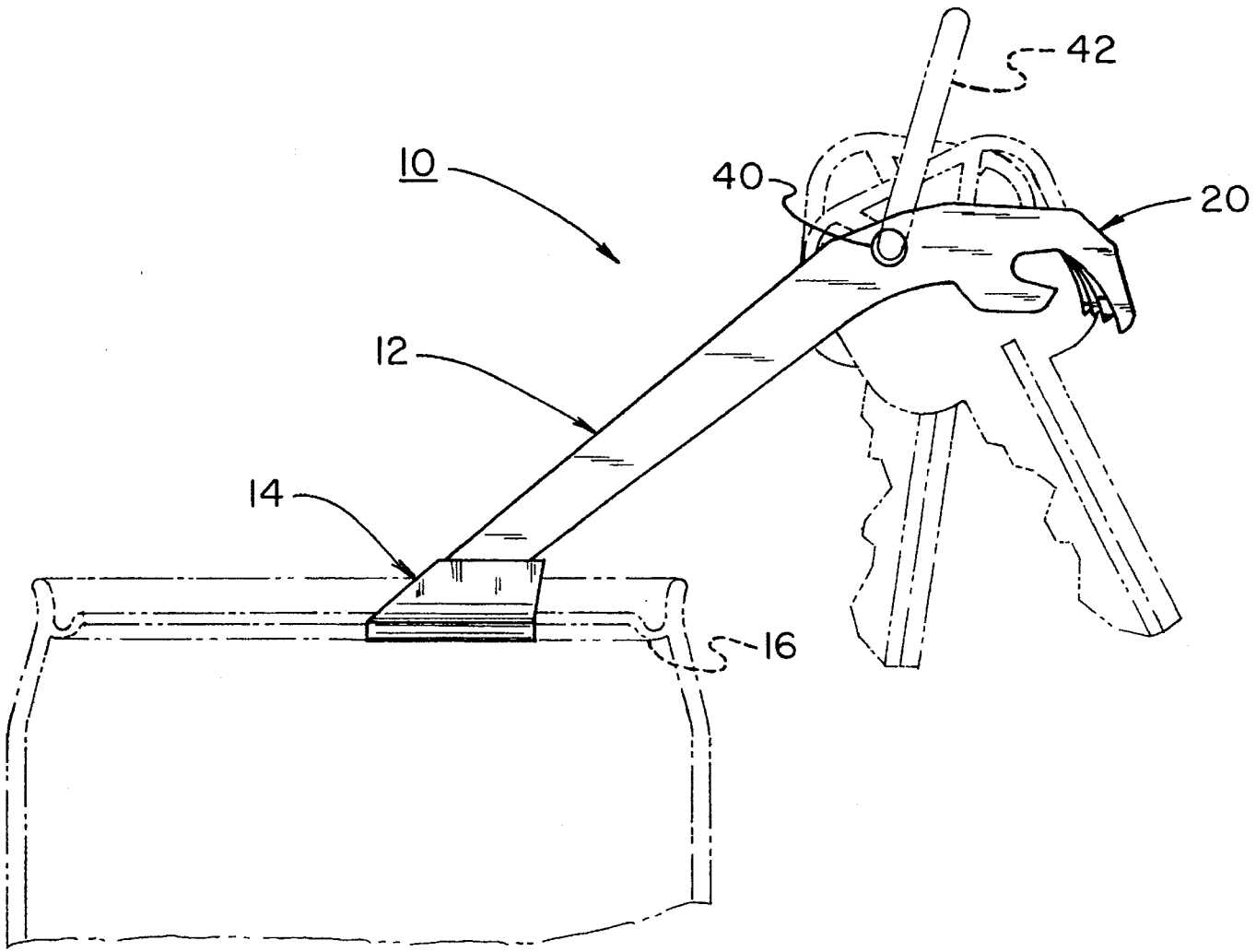
FIG. 1 is a side elevation view of a rim cleaning beverage container opener according to the present invention in use.

With reference now to the drawings, and in particular to FIGS. 1–4 thereof, a new rim cleaning beverage container opener embodying the principles and concepts of the present invention and generally designated by the reference numeral 10 will be described.

More specifically, it will be noted that the rim cleaning beverage container opener 10 comprises a handle means 12 for being grasped and manipulated by an individual during use of the device 10. A squeegee means 14 is mounted to a first end of the handle means 12 and operable for cleaning a rim 16 of a beverage container 18. An opening means 20 extends from a second end of the handle means 12 for facilitating manual opening of a beverage container tab or bottle cap.

Figure 2:
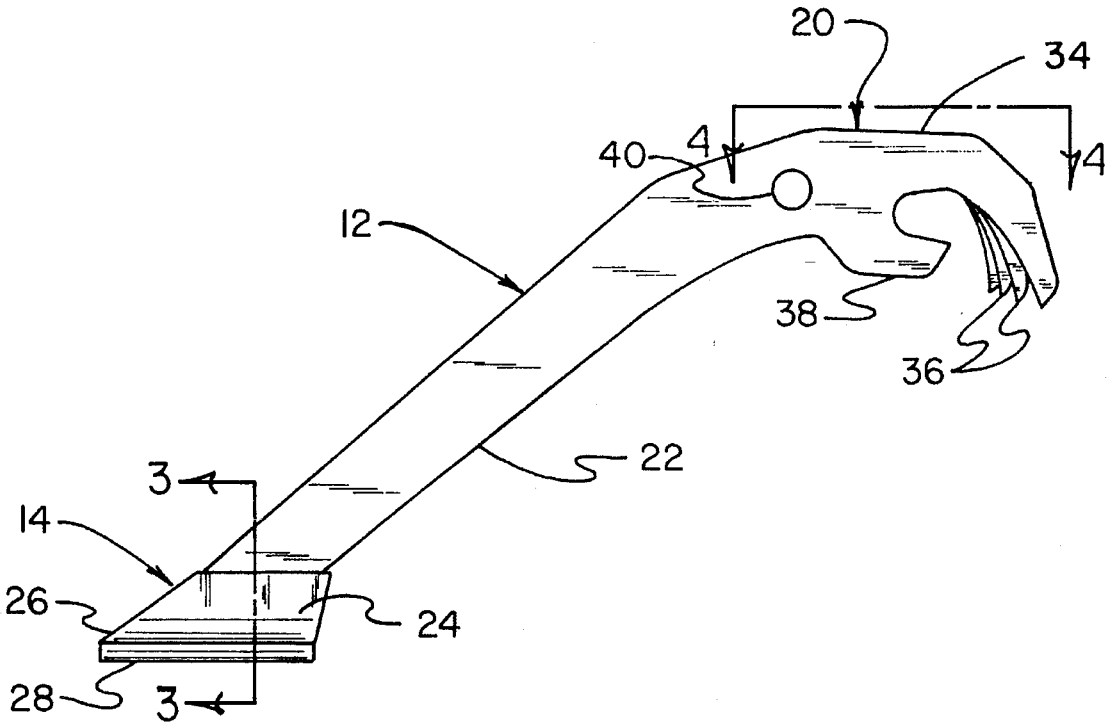
FIG. 2 is a side elevation view of the invention, per se.
Figure 3:
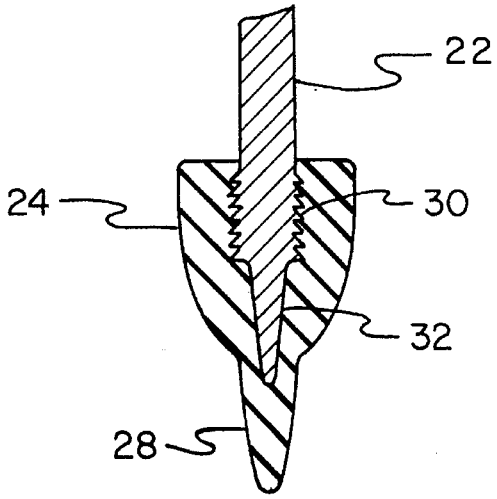
FIG. 3 is a cross sectional view taken along line 3—3 of FIG. 2.
Figure 4:
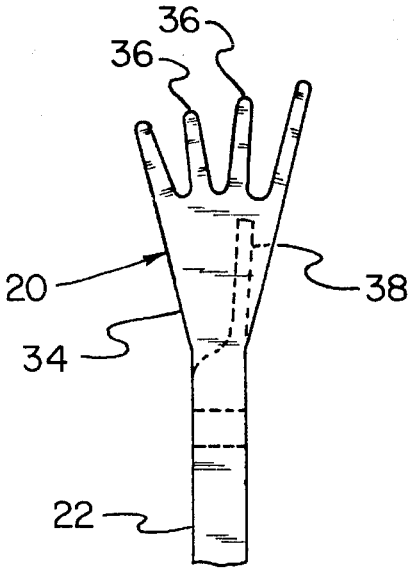
FIG. 4 is a top plan view of a portion of the present invention.

As best illustrated in FIGS. 2 through 4, it can be shown that the handle means 12 according to the present invention 10 comprises an elongated handle 22 which can be grasped and manipulated by an individual. The elongated handle 22 may be of any desired cross sectional shape, but is preferably of a rectangular cross sectional shape, as shown in the figures.

As shown in FIGS. 2 and 3, the squeegee means 14 according to the present invention 10 preferably comprises an elastomeric squeegee 24 coupled to a first end of the elongated handle 22 of the handle means 12. The elastomeric squeegee 24 is shaped so as to define an angled front edge 26 oriented at an oblique angle relative to an engaging blade 28 extending along a longitudinal edge of the elastomeric squeegee 24. To mount the squeegee 24 to the first end of the elongated handle 22, the elongated handle is preferably shaped so as to define a plurality of mounting projections 30 which engage interior surfaces of an unlabeled aperture formed in the elastomeric squeegee within which the first end of the handle projects. The elongated handle 22 may be shaped so as to define a blade reinforcing member 32 projecting at least partially into an interior of the engaging blade 28 substantially as shown in FIG. 3 to reinforce the engaging blade. By this structure, the engaging blade 28 of the squeegee 24 can be positioned within the rim 16 of the beverage container 18, as shown in FIG. 1, whereby a manual rotation of the squeegee means 14 in a circular manner will effect cleaning and removal of debris of the rim 16 of the container.

As shown in FIGS. 2 and 4, the opening means 20 according to the present invention 10 comprises an engaging head 34 projecting from a second end of the elongated handle 22 and preferably oriented at an oblique angle relative thereto. A plurality of projecting tines 36 extend from the engaging head 34 in a spaced relationship relative to one another and cooperate with a prying member 38 extending from the engaging head 34 to effect opening of a beverage container 18. The prying member 38 is oriented so as to extend beneath the plurality of the projecting tines 36 substantially as shown in the drawings. Preferably, the projecting tines 36 are of disparate lengths relative to one another, whereby an individual one of the projecting tines 36 can be utilized in cooperation with the prying member 38 to effect opening of a particular size of a container. In other words, depending upon a size of the container to be opened, any one of the projecting tines 36 can be utilized in cooperation with the prying member 38 to effect opening of the container. The opening means 20 according to the present invention 10 can be utilized to open beverage container tabs or bottle caps as desired.

As shown in FIG. 1, the handle means 12 according to the present invention 10 may further comprise a mounting aperture 40 directed through the elongated handle 22 which permits the direction of a keychain 42 therethrough to couple the device 10 to the keychain as desired.

In use, the rim cleaning beverage container opener 10 according to the present invention can be easily utilized to effect cleaning of the rim 16 of a beverage container 18 prior to opening thereof. The opening means 20 can then utilized to engage an opening tab of the beverage container to effect pivoting thereof to open the container in a well understood manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rim cleaning beverage container opener comprising:

a handle means for being grasped and manipulated by an individual;

a squeegee means mounted to a first end of the handle means for cleaning a rim of a beverage container;

an opening means extending from a second end of the handle means for facilitating manual opening of a beverage container.

2. The rim cleaning beverage container opener of claim 1, wherein the handle means comprises an elongated handle.

3. The rim cleaning beverage container opener of claim 2, wherein the squeegee means comprises an elastomeric squeegee coupled to a first end of the elongated handle of the handle means, the elastomeric squeegee being shaped so as to define an angled front edge and an engaging blade extending along a longitudinal edge thereof, with the angled front edge being oriented at an oblique angle relative to the engaging blade.

4. The rim cleaning beverage container opener of claim 3, wherein the elongated handle is shaped so as to define a plurality of mounting projections, and further wherein the elastomeric squeegee is shaped so as to define an aperture within which the first end of the handle projects, the mounting projections engaging interior surfaces of the aperture to secure the squeegee thereto.

5. The rim cleaning beverage container opener of claim 4, wherein the elongated handle is shaped so as to define a blade reinforcing member projecting at least partially into an interior of the engaging blade.

6. The rim cleaning beverage container opener of claim 5, wherein the opening means comprises an engaging head projecting from a second end of the elongated handle and oriented at an oblique angle relative thereto; a plurality of projecting tines extending from the engaging head in a spaced relationship relative to one another; and a prying member extending from the engaging head for cooperating with at least one of the projecting tines to effect opening of a beverage container.

7. The rim cleaning beverage container opener of claim 6, wherein the prying member is oriented so as to extend beneath the plurality of the projecting tines, wherein the projecting tines are of disparate lengths relative to one another, whereby an individual one of the projecting tines can be utilized in cooperation with the prying member to effect opening of a particular size of a container.

8. The rim cleaning beverage container opener of claim 2, wherein the opening means comprises an engaging head projecting from a second end of the elongated handle and oriented at an oblique angle relative thereto; a plurality of projecting tines extending from the engaging head in a spaced relationship relative to one another; and a prying member extending from the engaging head for cooperating with at least one of the projecting tines to effect opening of a beverage container.

9. The rim cleaning beverage container opener of claim 8, wherein the prying member is oriented so as to extend beneath the plurality of the projecting tines, wherein the projecting tines are of disparate lengths relative to one another, whereby an individual one of the projecting tines can be utilized in cooperation with the prying member to effect opening of a particular size of a container.

* * * * *